US007245856B2

(12) United States Patent
Furst et al.

(10) Patent No.: US 7,245,856 B2
(45) Date of Patent: Jul. 17, 2007

(54) SYSTEMS AND METHODS FOR REDUCING IMAGE REGISTRATION ERRORS

(75) Inventors: Michael R. Furst, Rochester, NY (US); Daniel W. Costanza, Webster, NY (US); Robert M. Lofthus, Webster, NY (US); Mark A. Omelchenko, Lexington, KY (US)

(73) Assignee: Xerox Corporation, Stamford, CT (US)

( * ) Notice: Subject to any disclaimer, the term of this patent is extended or adjusted under 35 U.S.C. 154(b) by 284 days.

(21) Appl. No.: 11/109,558

(22) Filed: Apr. 19, 2005

(65) Prior Publication Data

US 2006/0233569 A1 Oct. 19, 2006

Related U.S. Application Data

(60) Provisional application No. 60/631,651, filed on Nov. 30, 2004.

(51) Int. Cl.
*G03G 15/00* (2006.01)

(52) U.S. Cl. ..... 399/162; 399/375

(58) Field of Classification Search ..... 399/162, 399/364, 375, 384–387
See application file for complete search history.

(56) References Cited

U.S. PATENT DOCUMENTS

| | | | |
|---|---|---|---|
| 4,579,466 | A | 4/1986 | Sato et al. |
| 4,587,532 | A | 5/1986 | Asano |
| 4,836,119 | A | 6/1989 | Siraco |
| 5,004,222 | A | 4/1991 | Dobashi |
| 5,080,340 | A | 1/1992 | Hacknauer |
| 5,095,342 | A | 3/1992 | Farrell |
| 5,159,395 | A | 10/1992 | Farrell |
| 5,208,640 | A | 5/1993 | Horie |
| 5,272,511 | A | 12/1993 | Conrad |
| 5,326,093 | A | 7/1994 | Sollitt |
| 5,389,969 | A | 2/1995 | Suzuki |
| 5,435,544 | A | 7/1995 | Mandel |
| 5,473,419 | A | 12/1995 | Russel |
| 5,504,568 | A | 4/1996 | Saraswat |

(Continued)

FOREIGN PATENT DOCUMENTS

JP 11249527 A * 9/1999

OTHER PUBLICATIONS

Desmond Fretz, "Cluster Printing Solution Announced", Today at Xerox (TAX), No. 1129, Aug. 3, 2001.

(Continued)

*Primary Examiner*—David M. Gray
*Assistant Examiner*—Ryan Gleitz
(74) *Attorney, Agent, or Firm*—FaySharpe LLP; Eugene Palazzo

(57) ABSTRACT

An image processing apparatus including tandem print engines is provided for forming an image on an image receiving substrata. The apparatus includes a first print engine and a second print engine downstream from the first print engine. The second print engine is slaved to the first print engine. The first print engine has a first photoreceptor and a first period of revolution. The second print engine has a second photoreceptor and a second period of revolution. The image processing apparatus further includes an intermediate inverter that inverts the image receiving substrate between the first print engine and the second print engine. The inverter determines a phase difference between a first seam signal from the first photoreceptor and a second seam signal from the second photoreceptor.

23 Claims, 5 Drawing Sheets

U.S. PATENT DOCUMENTS

| | | | |
|---|---|---|---|
| 5,525,031 | A | 6/1996 | Fox |
| 5,557,367 | A | 9/1996 | Yang |
| 5,568,246 | A | 10/1996 | Keller |
| 5,570,172 | A | 10/1996 | Acquaviva |
| 5,596,416 | A | 1/1997 | Barry |
| 5,629,762 | A | 5/1997 | Mahoney |
| 5,710,968 | A | 1/1998 | Clark |
| 5,778,377 | A | 7/1998 | Marlin |
| 5,884,910 | A | 3/1999 | Mandel |
| 5,995,721 | A | 11/1999 | Rourke |
| 6,059,284 | A | 5/2000 | Wolf |
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |
| 6,384,918 | B1 | 5/2002 | Hubble, III |
| 6,450,711 | B1 | 9/2002 | Conrow |
| 6,476,376 | B1 | 11/2002 | Biegelsen |
| 6,476,923 | B1 | 11/2002 | Cornell |
| 6,493,098 | B1 | 12/2002 | Cornell |
| 6,537,910 | B1 | 3/2003 | Burke |
| 6,550,762 | B2 | 4/2003 | Stoll |
| 6,554,276 | B2 | 4/2003 | Jackson |
| 6,577,925 | B1 | 6/2003 | Fromherz |
| 6,607,320 | B2 | 8/2003 | Bobrow |
| 6,608,988 | B2 | 8/2003 | Conrow |
| 6,612,566 | B2 | 9/2003 | Stoll |
| 6,612,571 | B2 | 9/2003 | Rider |
| 6,621,576 | B2 | 9/2003 | Tandon |
| 6,633,382 | B2 | 10/2003 | Hubble, III |
| 6,639,669 | B2 | 10/2003 | Hubble, III |
| 6,819,906 | B1 | 11/2004 | Herrmann |
| 2002/0078012 | A1 | 6/2002 | Ryan |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz |
| 2004/0150158 | A1 | 8/2004 | Biegelsen |
| 2004/0153983 | A1 | 8/2004 | McMillan |
| 2004/0216002 | A1 | 10/2004 | Fromherz |
| 2004/0225391 | A1 | 11/2004 | Fromherz |
| 2004/0225394 | A1 | 11/2004 | Fromherz |
| 2004/0247365 | A1 | 12/2004 | Lofthus et al. |

OTHER PUBLICATIONS

Morgan, P.F., "Integration of Black Only and Color Printers", Xerox Disclosure Journal, vol. 16, No. 6, Nov./Dec. 1991, pp. 381-383.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004 deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.

* cited by examiner

SYSTEMS AND METHODS FOR REDUCING IMAGE REGISTRATION ERRORS

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. dejong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.;

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

BACKGROUND

The described exemplary embodiments generally relate to maintaining image registration in image processing. More particularly, the description relates to systems and methods in which image registration errors in output images are reduced in image processing systems that include tandem print engines. The tandem print engines, for example, can process single pass duplexing and/or multi-pass duplexing.

Electrophotography, a method of copying or printing documents, is performed by exposing a light image representation of a desired original image onto a substantially uniformly charged photoreceptor substrate, such as a photoreceptor belt. In response to this light image, the photoreceptor discharges to create an electrostatic latent image of the desired original image on the photoreceptor's surface. Developing material, or toner, is then deposited onto the latent image to form a developed image. The developed image is then transferred to an image receiving substrate. The surface of the photoreceptor is then cleaned to remove residual developing material and the surface as recharged by a charging device in preparation for the production of the next image.

Color images can be produced by repeating the above-described recording process once for each differently-colored toner that is used to make a composite color image. For example, in a one-color imaging process, referred to herein as the Recharge, Expose, and Develop, Image (REaD IOI) process, a charged photoreceptor surface is exposed to a light image that represents a first color. The resulting electrostatic latent image is then developed with a first colored toner. The toner is typically of a subtractive primary color, including magenta, yellow, cyan, or black. The charge, expose and develop process is repeated for a second colored toner, then for a third colored toner, and finally for a fourth colored toner. The four differently-colored toners are placed in superimposed registration on the photoreceptor so that a desired composite color image results. That composite color image is then transferred and fused onto an image receiving substrate.

Tandem print engine systems include two print engines arranged in a series configuration. Each print engine includes a photoreceptor belt and imagers disposed at spaced positions along the length, i.e., the process direction, of the photoreceptor belt. Each imager comprises an image source that exposes the photoreceptor belt. Typically, the image source includes a light emitting device that emits a light beam that is moved laterally across the photoreceptor belt to expose the photoreceptor belt to create a latent electrostatic image on the photoreceptor belt. Each latent image is then developed as outlined above. Image receiving substrates, such as sheets of copy paper, are fed in a time-controlled manner to the print engines. The first print engine transfers its developed image to the simplex side of the image receiving substrate. The image receiving substrate is then inverted and presented to the second print engine. The second print engine then transfers its developed image to the duplex side of the image receiving substrate.

Each photoreceptor belt of the first and second print engines includes a seam where opposed end portions of the photoreceptor belt are joined together. The photoreceptor belts include pitch regions in which images can be satisfactorily formed. Images cannot be satisfactorily formed at the seams, because the images formed at seams are normally defective. Accordingly, it is important to control the locations of the seams of both of the first and second photoreceptor belts during print runs, to prevent forming images at the seams, and to ensure that images are formed only in the pitch regions. A consistent and predictable placement of the photoreceptor belts, with respect to each other, is desirable in order to simplify an intermediate or inverter paper path between two print engines.

In a tandem print engine configuration, there are several technology issues involved with synchronizing two photoreceptor belt modules of two separate print engines in a manner that does not negatively impact the registration of either module. If the periods of revolution of the two photoreceptor belts are not matched, then the positions of the seams will also not be synchronized. The photoreceptor belts can have different lengths and, accordingly, in such configurations must rotate at different velocities (speeds) to maintain the same periods of revolution. If the periods of revolution are not synchronized appropriately to each other or with imager velocities, image to paper registration errors will occur during printing. The image to paper registration errors can be characterized as 1) simplex to duplex image registration errors if the photoreceptor and imager velocities for each print engine are not matched appropriately, or 2) image-on-image (IOI) registration errors from changes in the photoreceptor velocity or imager velocity while printing is occurring. Image-on-image registration errors occur during the building of color images on the photoreceptor belts. If, during stacking the multiple color separation layers of a color image on each other, the images are not aligned with each other, then image registration errors between the color separation layers will occur. These registration errors produce print defects such as color shifts and trapping errors.

Registration errors are caused generally by the motion quality of the photoreceptor belts and the manner that the imagers form the latent images on the photoreceptor belts. Regarding the motion quality of the photoreceptor belts, image registration errors can be caused by changes in the photoreceptor belt velocity, making it difficult to form images smoothly and to align lead edges of the images on the photoreceptor belt. Velocity changes can occur due to various different factors, including errors of the drive motor, errors in roller velocities and diameters, belt length changes during operation due to tension and thermal effects, and normal roller and belt tolerances.

Factors that can cause registration errors in the manner in which the imagers form the latent images, include errors in the lateral scan velocity, i.e., the exposure velocity, of the image sources across the photoreceptor belt, the scanning start and end points of the scanning light beam, and the length of the scan lines.

In simplex (single print engine) configurations, the image registration can be set up off-line. Thus, adjustments can be made at times when print runs are not being performed. In such configurations, the photoreceptor belt velocity is maintained as constant as possible to minimize registration errors. In addition, the imagers are set to a specific reference and their velocity is tightly maintained. If, during the course of producing an image, the velocity of the photoreceptor belt and the scan velocity of the image sources of the imager vary with respect to each other, either in position or velocity, then registration errors will occur.

Simplex print engine systems can include monitoring systems for measuring and compensating for image registration errors. Simplex print engine systems can calibrate themselves to the characteristics of the photoreceptor belt to achieve good image alignment for color images. If the photoreceptor belt runs either too fast or too slow, the scan velocity of the image sources can be automatically adjusted to counter the change in the photoreceptor belt velocity. As long as the photoreceptor belt velocity is maintained substantially constant, then only small image registration errors occur due to the self-correcting measures that are taken by the system.

For tandem print engine configurations, however, the synchronization requirements for the two print engines require that the photoreceptor belt velocity of the downstream print engine, i.e., the "slave print engine," must be adjusted to keep it timed with the period of revolution of the photoreceptor belt of the upstream print engine, i.e., the "master print engine," Otherwise, it is not possible to control the locations of the seams of the photoreceptor belts of the master and slave print engines. As explained, it is important to control the seams to prevent the formation of images on the seams.

In tandem print engine configurations, various factors can cause the two photoreceptor belts to be out of synchronization with each other. Namely, the photoreceptor belt velocities and lengths can change over time due to changes in the roller diameters, encoder diameters and thermal effects. The belt length can be out of specification originally and can also vary during operation due to stretch caused by tension and thermal effects. The encoder roller that measures the belt velocity can change in diameter due to thermal effects. Consequently, the photoreceptor belts can run at different periods of revolution. In addition, errors can occur between the scan velocities of the image sources of the imagers of the different print engines. However, as outlined above, the scan velocities of the imagers also need to be coordinated with the velocity of the associated photoreceptor belt to maintain proper overall image quality.

In order to synchronize the photoreceptor belts of the master and slave print engines, the photoreceptor belt velocity of the slave print engine can be changed. In making such adjustments for the slave print engine, the slave print engine should be adjusted on-line. Otherwise, the productivity of the tandem print engine is decreased.

One possible approach to making such velocity adjustments while the slave print engine is on-line includes making the velocity adjustments for the slave print engine sufficiently small that the adjustments would produce registration errors so small that they would be almost imperceptible. This approach, however, requires stringent adjustment resolution or quantization levels in the photoreceptor belt and in imager controllers of the slave print engine, because both subsystems will need to be adjusted when the photoreceptor belt velocity is adjusted. The cost implications of such fine adjustment capability are high.

A high level of resolution is presently achievable for the slave print engine photoreceptor belt module. Velocity resolutions down to about 1/64 Hz (or 0.00082%) can currently be achieved. Such small changes are expected to be imperceptible. Thus, the photoreceptor belt velocity of the slave print engine could be adjusted slowly at a sufficiently small step size without undue registration errors occurring.

It is not, however, presently possible to satisfactorily reduce the image registration errors by making such small step size adjustments of the photoreceptor belt velocity for the slave print engine. That is, in tandem print engines, the ratio of the velocity of the photoreceptor belt and the velocity of the imagers, for example the scan velocity, or exposure velocity, of image sources, defines the absolute magnification of the final image that is formed on the photoreceptor belt. Accordingly, if the photoreceptor belt velocity is changed, then the imager velocity must also be changed to maintain the desired ratio, or else the length of the image in the process, or slow scan, direction will change. Consequently, the imager velocity must be adjusted to maintain the desired absolute magnification, to maintain the ratio of the photoreceptor belt velocity to the imager velocity.

Imager controllers can have, for example, 32, 64, 128 or 256 discrete levels of imager scan velocity adjustment for the light emitting devices. With 256 steps over the adjustment range that is desirable for imagers, which is typically about 1.6%, the adjustment resolution is about 0.0125% per step. This adjustment resolution is very coarse, and is about fifteen times greater, compared to present adjustment capabilities of photoreceptor belt controllers. This adjustment resolution would cause significant image registration errors if changes were made to the imager velocity during a print run. However, improving upon this adjustment resolution of the imagers is not a satisfactory solution to this problem, because, as the number of adjustment level increases, the more difficult the adjustment implementation becomes and the more expensive the adjustment system generally becomes.

Adjusting the velocities of the imagers at the coarse adjustment capabilities of the imager controller is also unsatisfactory. That is, in order to avoid large registration errors, it would be necessary to make changes to the imager velocity only at times when print runs are not being performed, i.e., when the slave print engine is off-line. This approach would require that the slave print engine be taken off-line periodically and skipping one revolution of the photoreceptor belt to adjust the imager velocity. This approach would create a decrease in the tandem print engine productivity, as the master print engine would also have to go off-line at the same time. In addition, this approach would also add additional complexity to the machine communications and scheduling algorithm needed for tandem print engine configurations. Accordingly, making adjustments to the imager velocity off-line would also be unsatisfactory.

One possible approach to making such velocity adjustments while the slave print engine is on-line includes matching the periods of revolution of the photoreceptors of the master and slave print engines during print runs, by simultaneously adjusting both the velocity of the slave photoreceptor and imagers of the slave engine. The velocity controllers for the slave photoreceptor and imagers can have the same dynamic response and can be simultaneously actuated, to minimize incremental registration errors in the slave print engine. Cross reference is made to commonly assigned U.S. Pat. No. 6,219,516, the disclosure of which being totally incorporated herein by reference.

As discussed in greater detail below, changes in the ratio between the velocities of the photoreceptor belt and the imagers in a print engine cause image to paper registration errors in the print engine. A phase difference between the master print engine and the slave print engine due to an intermediate inverter also causes registration errors. The phase difference represents a transit time for the substrate to travel through the inverter.

The velocity adjustments can thus be made at an adjustment level that can be achieved by the controllers of both the photoreceptor and the imagers. Thus, even in systems in which the adjustment resolution capabilities of the two subsystems vary significantly, the adjustments to both systems can be made at an adjustment level that is achievable by both systems.

Because it is not necessary to take the slave print engine off-line periodically to make such adjustments, the systems and methods hereinafter described can improve productivity in tandem print engine configurations. The systems and methods described avoid the need to introduce additionally complex machine communications and scheduling techniques that would be needed to be able to make adjustments off-line in tandem print engine configurations. The exemplary embodiments also avoid the need for an intermediate buffer tray to hold substrates while they move from the master print engine to the slave print engine.

BRIEF DESCRIPTION

One exemplary embodiment of an image processing system that forms an image on an image receiving substrate comprises a first print engine and a second print engine downstream from the first print engine. The second print engine is slaved to the first print engine. The first print engine comprises a first photoreceptor having a first period of revolution. The second print engine comprises a second photoreceptor having a second period of revolution. The image processing apparatus further comprises an intermediate inverter that inverts the image receiving substrate between the first print engine and the second print engine, wherein the first print engine prints on a simplex side of the image receiving substrate and the second print engine prints on a duplex side of the image receiving substrate. The inverter determines a phase difference between a first seam signal from the first photoreceptor and a second seam signal from the second photoreceptor.

Another exemplary embodiment of an image processing apparatus with tandem print engines for forming an image on an image receiving substrate comprises a first print engine including a first photoreceptor having a first photoreceptor belt with a first period of revolution. The apparatus further includes a second print engine downstream from the first print engine, the second print engine including a second photoreceptor having a second photoreceptor belt with a second period of revolution. The apparatus further comprises an inverter between the first print engine and the second print engine. The inverter has a constant time period for inverting a substrate from the first print engine to the second print engine. A tandem print controller determines the equivalent position difference at start up between a first seam in the first photoreceptor belt and a second seam in the second photoreceptor belt wherein said equivalent position difference substantially equal to the time period for inverting.

Still another exemplary embodiment includes an image processing method for forming an image on an image receiving substrate using an image processing apparatus comprising a first print engine having a first photoreceptor belt with a first period of revolution, and a second print engine arranged in tandem with the first print engine, the second print engine having a second photoreceptor belt with a second period of revolution. The apparatus further includes an inverter between the first and the second print engine. The method includes measuring an inverter period. The inverter period substantially matches a transit time of a substrate between the first print engine and the second print engine. The method further includes parking the second print engine such that a seam in the second photoreceptor belt is offset by the inverter period relative to a seam in the first photoreceptor belt. Additionally, the first period of revolution of the first photoreceptor belt and the second period of revolution of the second photoreceptor belt are measured. A gain factor is then calculated by determining a ratio between the first period of revolution and the second period of revolution.

Yet another exemplary embodiment includes an image processing method for forming an image on an image receiving substrate using an image processing apparatus comprising a first print engine including a first photoreceptor belt having a first period of revolution, and a second print engine arranged in tandem with the first print engine and including a second photoreceptor belt having a second period of revolution. A plurality of imagers form an image on the second photoreceptor belt. The method includes offsetting a seam in the second photoreceptor belt by a period substantially equal to a transit time for a substrate to travel through an inverter between the first print engine and the second print engine. The first period of revolution of the first photoreceptor belt is maintained substantially equal to the second period of revolution of the second photoreceptor belt during a print run. A substantially constant ratio is maintained between the velocity of the second photoreceptor belt and an exposure velocity of the plurality of imagers during the print run. The method further includes printing a first image on the image receiving substrate at the first print engine, and printing a second image on the image receiving substrate at the second print engine.

DRAWING DESCRIPTIONS

FIG. 1 schematically illustrates a tandem print engine system;

Figure 4:
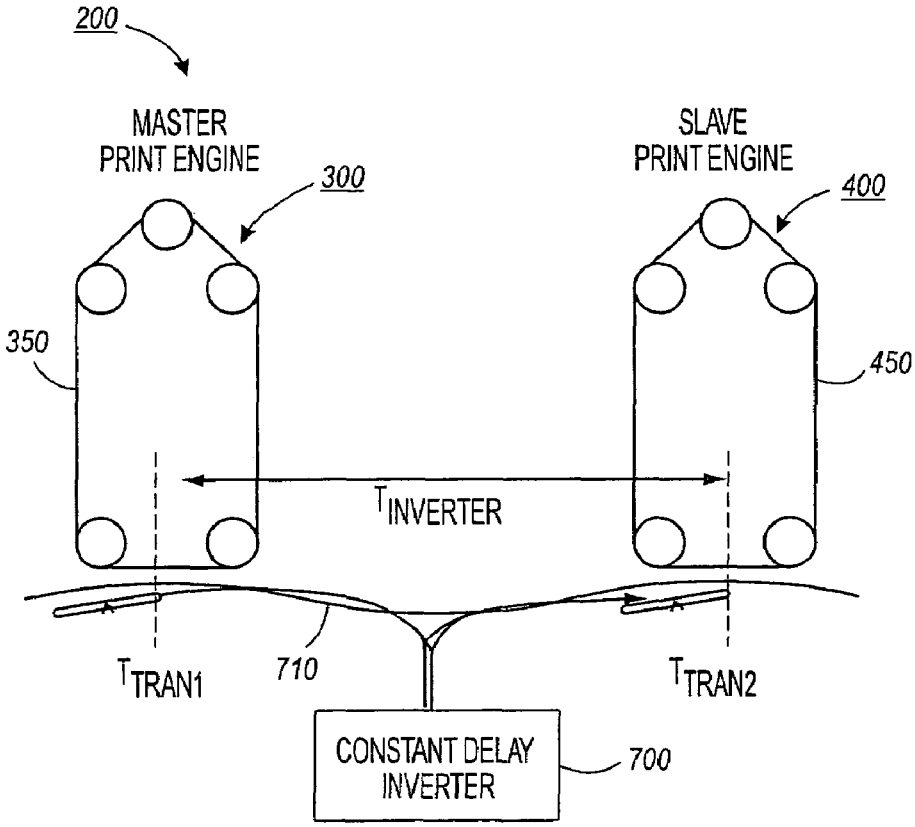
Figure 5:
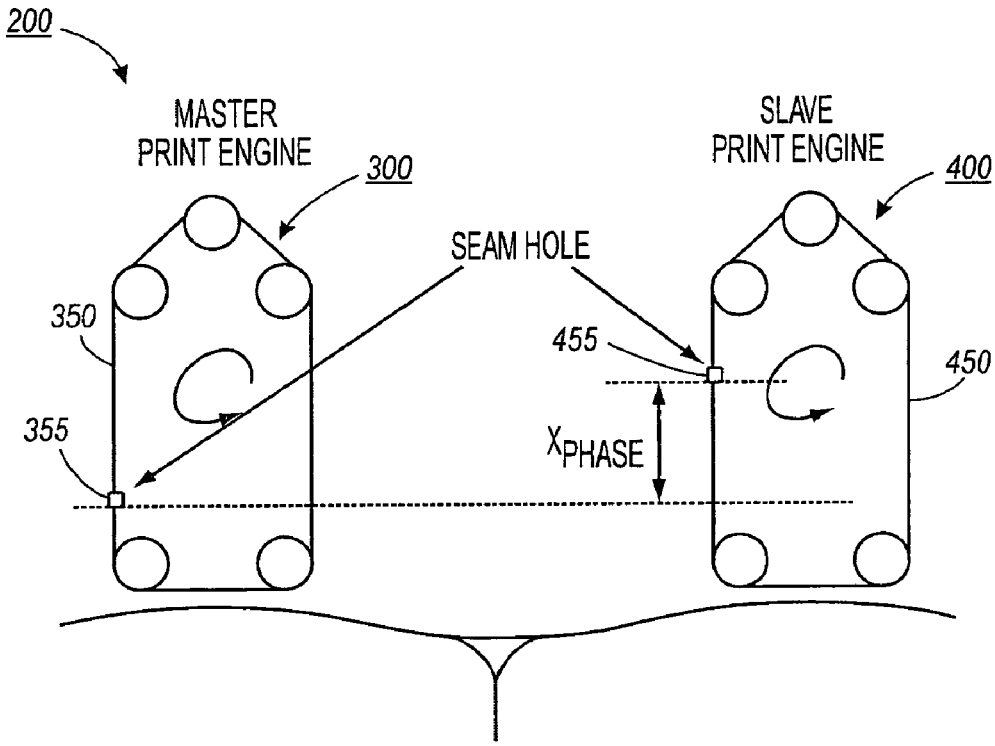

FIG. 4 schematically illustrates a tandem print engine and a constant delay inverter; and, FIG. 5 schematically illustrates a phase relationship between first and second print engines in the tandem print system.

DETAILED DESCRIPTION

The apparatus and method to be described in more detail hereinafter includes a machine configuration where two (or more) standard print engines or image output terminals (IOTs) will be placed in series to provide single pass duplex prints. The first IOT can print the simplex side, the paper can then move through an intermediate transport where it is inverted and presented to the second IOT where the duplex side can be printed. One issue involved with appending two print engines is the synchronization of the seams of both photoreceptor (P/R) belts such that the seam on the second P/R module never ends up in the image area. A consistent and predictable placement of the P/R belts with respect to each other also allows the intermediate paper path to become much simpler. If synchronized properly, there will be no need of an intermediate buffer tray to hold prints while they move from the master print engine to the slave print engine and scheduling of the images becomes very predictable.

One exemplary embodiment of an image processing apparatus incorporating image registration control systems in accordance with the exemplary embodiments is described below. An image data source and an input device can be connected to the image processing apparatus over links. The image data source can be a digital camera, a scanner, or a locally or remotely located computer, or any other known or later developed device that is capable of generating electronic image data. Similarly, the image data source can be any suitable device that stores and/or transmits electronic image data, such as a client or a server of a network. The image data source can be integrated with the image processing apparatus, as in a digital copier having an integrated scanner, or the image data source can be connected to the image processing apparatus over a connection device, such as a modem, a local area network, a wide area network, an intranet, the Internet, any other distributed processing network, or any other known or later developed connection device.

It should also be appreciated that, while the electronic image data can be generated at the time of printing an image from electronic image data, the electronic image data can be generated at any time prior to the printing. Moreover, the electronic image data need not be generated from an original physical document, but can optionally be created from scratch electronically. The image data source thus can be any known or later developed device that is capable of supplying electronic image data over the link to the image processing apparatus. The link can thus be any known or later developed system or device for transmitting the electronic image data from the image data source to the image processing apparatus.

The input device can be any known or later developed device for providing control information from a user to the image processing apparatus. Thus, the input device can be a control panel of the image processing apparatus, or can be a control program executing on a locally or remotely located general purpose computer, or the like. The link(s) can be any known or later developed device for transmitting control signals and data input using the input device from the input device to the image processing apparatus.

Figure 1:
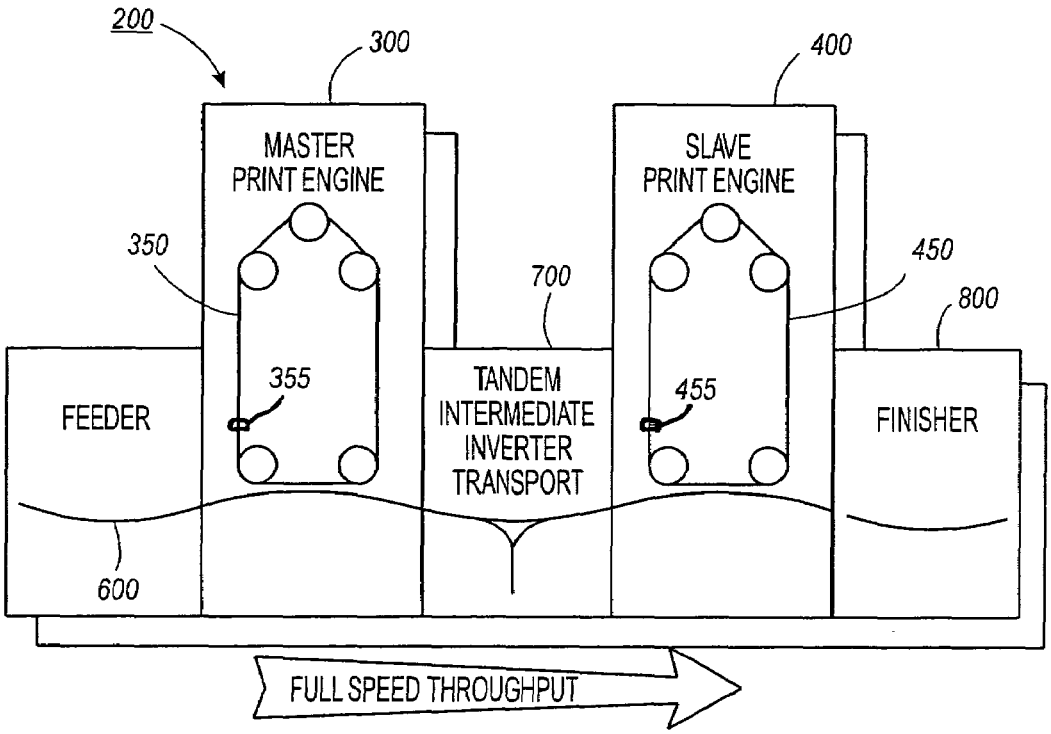
Figure 2:
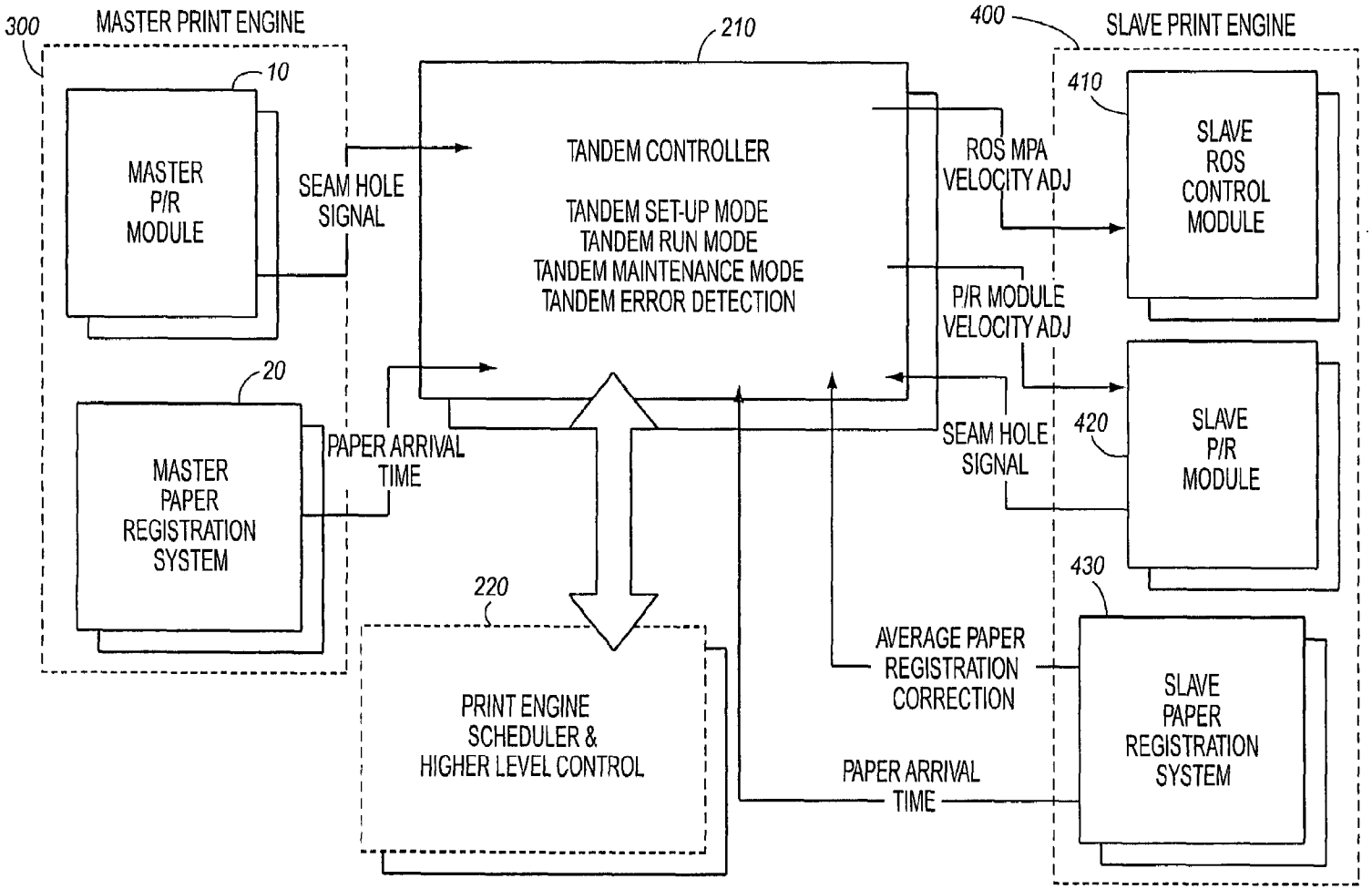
FIG. 2 shows one exemplary embodiment of an image processing apparatus that incorporates the image registration control system.

As shown in FIGS. 1 and 2, in one exemplary embodiment, the image processing apparatus 200 includes a tandem controller 210, a print engine scheduler 220, a master print engine or module 300, and a slave print engine or module 400. The master print engine can include a master photoreceptor (P/R) module 310 and a master paper registration system 320. The slave print engine 400 can include a slave raster output scanner (ROS) control module 410, a slave P/R module 420, and a slave paper registration system 430.

As best shown in FIG. 1, the tandem print engine includes the master print engine 300 and the slave print engine 400 arranged in a series configuration. During a print run of the image processing apparatus 200, a feeder 600 feeds an image receiving substrate, such as copy paper, to the master print engine 300. The image receiving substrate has a simplex side and a duplex side. The master print engine 300 prints an image on the simplex side of the image receiving substrate. The image receiving substrate is then inverted by an inverter transport device 700, disposed between the master print engine 300 and the slave print engine 400, and transported to the slave print engine 400. The slave print engine 400 can print another image on the duplex side of the image receiving substrate. The image receiving substrate is then transported to a finisher device 800. The master print engine 300 includes a P/R that comprises a master P/R belt 350 and the slave print engine 400 includes a P/R that comprises a slave P/R belt 450. As shown in FIGS. 1 and 5, the master P/R belt 350 has a seam 355 and the slave P/R belt 450 has a seam 455.

One component of the image processing apparatus 200 is the tandem controller 210 and the algorithms which are programmed into this controller 210. To be described in more detail hereinafter, the tandem controller 210 can determine the desired phase delay between the two print engines 300, 400, synchronize the print engines, and maintain that synchronization in the presence of thermal and other disturbances.

One module is determined to be the master or first print engine 300 and another module is determined to be the slave or second print engine 400. The master P/R belt 350 and the slave P/R belt 450 each rotate at a selected period of revolution, i.e., the amount of time for the belt to make one complete revolution. The tandem controller 210 adjusts the velocity of the slave P/R belt 450 and the velocity of the imagers of the slave print engine 400, if the sensors associated with the master P/R belt 350 and the slave P/R belt 450, indicate that the periods of revolution of the master and slave P/R belts 350, 450 are not properly matched. As the master's period of revolution changes, the slave will be required to follow. The tandem controller determines the appropriate corrections to be made to both the P/R module and motor and polygon assembly (MPA) velocities for the slave print engine 300 to keep the two modules synchronized without impacting an 101 (image-on-image) registration on either print engine. The MPA comprises a servo system which regulates the polygon speed. Only the inputs and outputs of the portion of the tandem print engine system that are under the influence of the tandem controller are shown in FIG. 2.

The tandem controller 210 can compare the periods of each P/R belt 350, 450 as it travels around the respective P/R module 300, 400 and calculate a gain factor based on the ratio of these two periods.

$$\text{gain_Factor} = \frac{\text{slave_Period}}{\text{master_Period}}$$

This gain factor is then applied to the current slave P/R and ROS MPA velocities to correct for the difference in the period. The change is a relative change based on the master P/R module's velocity. The slave P/R velocity is changed to ensure the two P/R belt seams are fixed in relation to one another. Once the slave P/R belt speed is changed, the ROS MPA speeds must be changed as well so that the process direction magnification of the prints remains constant. Corrections can be made to both the P/R belt velocity and the ROS MPA velocities simultaneously.

The corrections are made in a relative sense rather than as an absolute velocity change. The changes relative to the master P/R module's velocity is sufficient because the absolute belt speed tolerances on a single P/R module are acceptable. The corrections simply ensure that the two P/R belt revolution periods are identical, but it is to be appreciated that the individual belt velocities may vary slightly from the nominal.

Figure 3:
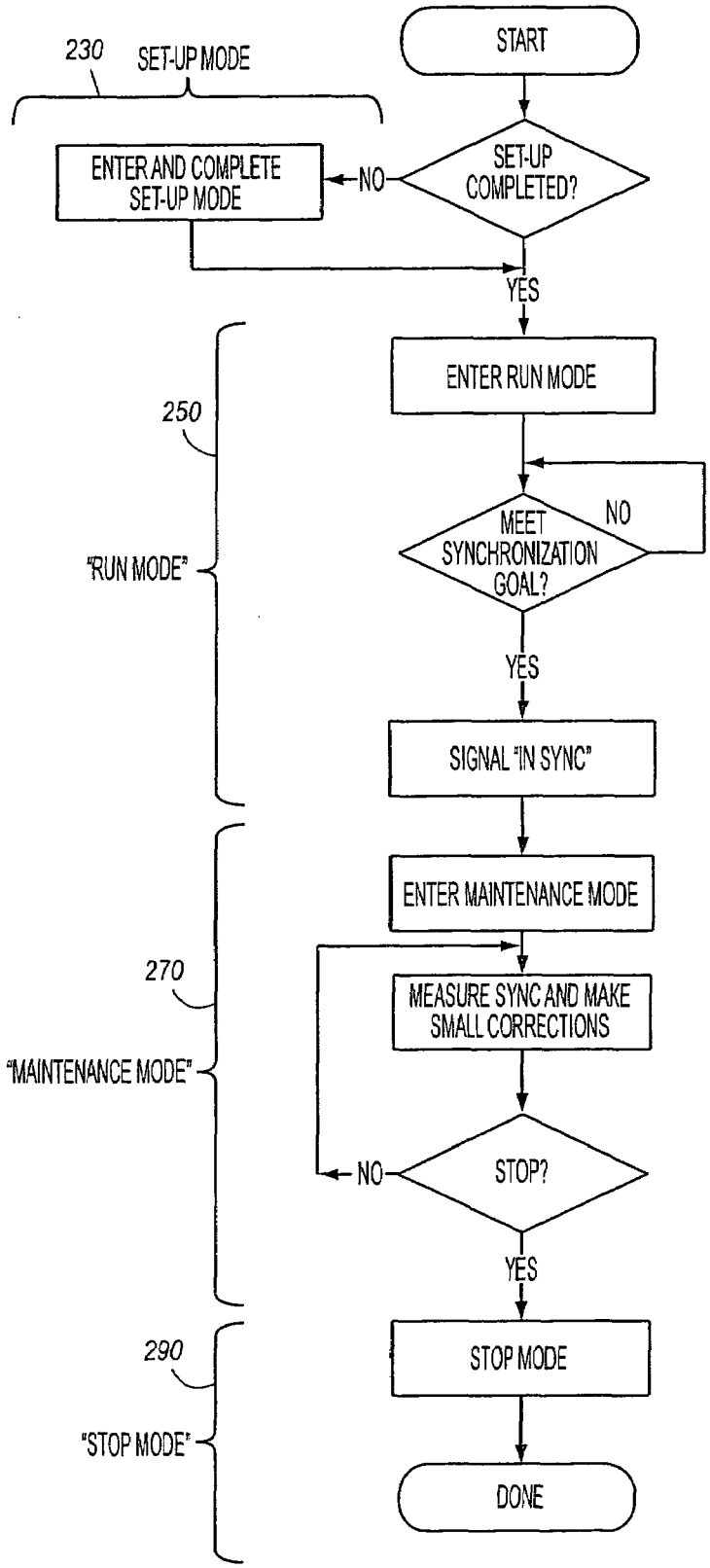
FIG. 3 is a flowchart outlining one exemplary embodiment of a control method.

Referring now to FIG. 3, a flowchart is therein displayed showing how the tandem control system 210 can be operated. The tandem print engine control system can be outlined in the following operational modes: a set-up mode 230, a print mode 250, a run/maintenance mode 270, and a stop mode 290.

The tandem set-up mode 230 will move the two independent print engines from unknown P/R module seam phase orientations and place them in relationship to each other in such a way that the start-up transients and registration effects are minimized at the beginning of the print run. The phase difference (in time) between two belt seam signals (or seam hole signals) must first be determined. The two seam signals comprise a first seam signal from the master P/R module and a second seam signal from the slave P/R module. This will provide the proper synchronization phase difference or orientation between the two P/R belt modules that can then be maintained by the tandem controller. One component that enables the tandem controller to be effective is the inverter 700 shown in FIG. 4. The inverter 700 can maintain a phase difference between the two signals as different length papers are fed into the image processing apparatus 200. It is to be appreciated that a constant phase difference or constant delay can be easily maintained when the same sized paper is fed into the image processing apparatus 200. An intermediate inverter paper path with a constant delay, regardless of paper size, can reduce the set-up time between feeding various sizes of paper, or to enable variable size paper to be run through the apparatus 200.

If the time through an inverter path 710 is not known, it must be measured to determine the proper phase relationship of the two seam holes of the master and slave P/R module 300, 400. To measure inverter time, paper can be passed through the system. The average time from a paper registered signal on the master P/R module to a paper registered signal on the slave P/R module 400 is recorded. At this stage, imaging is not being performed, only the paper inverter time or transit time is being measured. The paper is not registered actively and no corrections are made during this test. The measurement of inverter time is represented and shown as $T_{inverter}$. The desired phase difference between the first and second seam hole signals can then be calculated as follows:

$$T_{phase} = T_{inverter} \bmod T_{period1} \text{[mod=modulus]}$$

given the fact that when synchronized $$T_{period1} = T_{period2}$$

The aforementioned will result in a time period that is less than one belt period and represents the proper phase delay (in time) between the two seam hole signals. In addition, $X_{phase}$ can be calculated and represents the equivalent position difference along the P/R belt travel in the two seam holes as shown in FIG. 5 and as detailed below:

$$X_{phase} = T_{phase} \cdot V_{mod2}.$$

The belt modules can now be run independently and the periods of their rotation measured along with an average period for both the master and slave P/R modules. The desired slave P/R velocity can be calculated by the following equation or control law:

$$V_{slave} = V_{slave} \cdot \left(1 + \frac{(T_{periodSlave} - T_{periodMaster})}{T_{periodMaster}}\right).$$

At the completion of the period measurement, the P/R modules 300, 400 can each be parked in such a way that they are in the right phase orientation for running. Once parked the desired or new velocity can be downloaded to the slave P/R module. A new slave MPA clock is calculated based on the same gain factor as used in the change in slave velocity and downloaded. If the reference phase delay between the seam hole signals was just learned, then the system can be started up and several sheets fed to make sure that the paper path can properly register the paper at the slave module 400. Average paper registration correction during printing may be used to fine tune the phase reference determined above. This function requires communication from the paper registration system. The set-up mode 230 is now complete.

The print mode 250 of operation will now be described. The effect of such mode of operation is to get the two P/R modules 300, 400 sufficiently synchronized that the paper registration system can adjust the paper to image registration sufficiently. The print mode 250 of operation is also responsible for keeping the two P/R modules synchronized in the presence of thermal disturbances, P/R belt stretch, and measurement errors, etc. Corrections can be made to the slave print engine to make it follow the master print engine. All corrections performed on-line (i.e. while making prints) must be done in such a way as to minimize their registration effects. Once the set-up routine has been run and the modules are synched together the system is ready to make prints.

Printing initiates by issuing simultaneous start commands to both the master and slave P/R modules. It is to be appreciated that the closer to starting at the same time the better the start up transient will be. The phase relationship of the two seam holes can be checked for acceptability. Acceptability is determined by conformance within a certain phase target in mm or sec. One example is a phase target of about ±4 mm. The tandem controller can then issue a signal that the P/R modules are synched and ready for printing.

The tandem controller then transitions to a maintenance mode 270. The maintenance mode ensures that the two P/R modules maintain synchronism such that the paper registration system can adjust the paper to image registration sufficiently. The maintenance mode also keeps the two P/R modules synchronized in the presence of thermal disturbances, P/R Belt stretch, and measurement errors, etc. Corrections will be made to the slave print engine to make it follow the master print engine. All corrections performed on-line (i.e. while making prints) must be done in such a way as to minimize their registration effects. The corrections include the following steps. The phase difference between the two seam signals can be measured on each belt revolution. As known to those skilled in the art, any necessary filtering is applied to the feedback. The filtered phase difference is compared to the desired phase difference and an error is formed. The control law can be applied to the error signal and a new slave velocity can be calculated. The new MPA velocity is then calculated based on the changes to the new P/R module velocity. Updates are made to the slave velocity such that registration impacts are minimized. Updates can also be made to the MPA clock if the resolution is available. If the resolution is not available, then changes are made when the velocity of the P/R module has shifted sufficiently that the absolute process magnification is out by the maximum target (i.e. 4 mm). The slave paper registration system can be periodically polled for the average correction being made. If the average correction is >±4 mm, for example, from zero then the additional position error is slowly added (subtracted) from the phase reference ($T_{phase}$) to fine tune the desired phase relationship. This is done to help the paper registration system keep the corrections centered around 0 mm. The corrections are then repeated on the next belt revolution.

Minimizing the start-up transient of the tandem print engine configuration is desirable and is facilitated by parking the P/R belts in the proper phase relationship. The belts can be stopped independently as long as they are parked in the proper orientation as described above.

The tandem architecture described above can work for any size paper once the phase delay is set up. For the system to be independent of paper size, a constant delay intermediate inverter paper path can be used. It is to be appreciated that the intermediate inverter paper path can maintain a constant time period to move the substrate from transfer zone 1 (on the master print engine) to transfer zone 2 (on the slave print engine).

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. An apparatus comprising:

a first print engine comprising a first photoreceptor including a first photoreceptor belt having a first period of revolution;

a second print engine comprising a second photoreceptor including a second photoreceptor belt having a second period of revolution;

an intermediate inverter that inverts an image receiving substrate during movement of the said image receiving substrate between the first print engine and the second print engine, wherein the first print engine prints on a simplex side of said image receiving substrate and the second print engine prints on a duplex side of said image receiving substrate; and, said inverter determines a phase difference between a first seam signal from said first photoreceptor and a second seam signal from said second photoreceptor.

2. The apparatus of claim 1, wherein said phase difference applied to said second seam signal from said second photoreceptor at start up, thereby establishing an equivalent position difference between said second seam signal and said first seam signal.

3. The apparatus of claim 2, wherein said phase difference substantially matches a transit time for said substrate to travel through said inverter.

4. The apparatus of claim 3, further including a tandem print controller that compares the first period of revolution of the first photoreceptor belt and the second period of revolution of the second photoreceptor belt during a print run of the image processing apparatus; and, said tandem print controller calculates a gain factor based on the ratio between said first period of revolution and said second period of revolution.

5. The apparatus of claim 4, wherein said gain factor is applied to a second photoreceptor belt velocity and a raster output scanner MPA velocity of said second print engine to correct for a difference between said first period of revolution and said second period of revolution.

6. The apparatus of claim 5, wherein said tandem controller adjusts the second photoreceptor belt velocity and the ROS MPA velocity, respectively, at substantially the same quantization level.

7. The apparatus of claim 5, wherein the second print engine is positioned downstream from the first print engine.

8. The apparatus of claim 5, wherein said gain factor is a relative correction based on a ROS MPA velocity of said first photoreceptor.

9. The apparatus of claim 6, wherein said first period of revolution substantially matches said second period of revolution.

10. The apparatus of claim 9, wherein the first belt velocity and the second belt velocity vary slightly from a nominal.

11. An apparatus comprising:

a first print engine comprising a first photoreceptor including a first photoreceptor belt having a first period of revolution;

a second print engine downstream from the first print engine, the second print engine comprising a second photoreceptor including a second photoreceptor belt having a second period of revolution;

an inverter between said first print engine and said second print engine, said inverter having a constant time period for inverting a substrate from said first print engine to said second print engine; and, a tandem print controller that determines an equivalent position difference at start up between a first seam in said first photoreceptor belt and a second seam in said second photoreceptor belt wherein said equivalent position difference substantially equal to said time period for inverting.

12. The apparatus of claim 11, wherein said tandem controller further controls (i) a velocity of the second photoreceptor belt such that the second period of revolution of the second photoreceptor belt substantially matches the first period of revolution of the first photoreceptor belt during a print run, and (ii) exposure velocities of the image sources on the second photoreceptor belt so as to maintain a substantially constant ratio between the velocity of the second photoreceptor belt and the exposure velocities during a print run.

13. The apparatus of claim 12, wherein the tandem print controller adjusts the second photoreceptor velocity by a gain factor, said gain factor is equivalent to the relative difference between said second period of revolution and said first period of revolution.

14. A printing system comprising:

an inverter having a period, said inverter period substantially matches a transit time of an image receiving substrate between a first print engine and a second print engine;

said second print engine is parked such that a seam in a second photoreceptor belt is offset by said inverter period relative to a seam in a first photoreceptor belt;

said first photoreceptor belt having a first period of revolution;

said second photoreceptor belt having a second period of revolution;

a gain factor is calculated by determining a ratio between the first period of revolution and the second period of revolution.

15. The system of claim 14, wherein said gain factor is applied to a second photoreceptor belt velocity and a raster output scanner MPA velocity of said second print engine to correct for a difference between said first period of revolution and said second period of revolution.

16. The system of claim 15, wherein a first image is formed on the image receiving substrate at the first print engine, the first image having a first image registration error;

a second image is formed on the image receiving substrate at the second print engine, the second image having a second image registration error;

said second image registration error is compared to a desired value and a difference is determined therefrom; and, said inverter period adjusted by said difference.

17. The system of claim 14, further comprising:

the first and second periods of revolution are matched including:

a difference between the measured first period of revolution and the measured second period of revolution is determined;

a second photoreceptor belt velocity is adjusted such that the second period of revolution substantially matches the first period of revolution; and the second photoreceptor belt velocity is adjusted simultaneously with an adjustment of an exposure velocity of each of the image sources to maintain a substantially constant ratio between the belt velocity and the exposure velocities during a print run.

18. The system of claim 17, further comprising:

the second photoreceptor belt velocity is adjusted such that the second period of revolution of the second photoreceptor belt substantially matches the first period of revolution of the first photoreceptor belt during the print run; and, the exposure velocity of the image sources is correspondingly adjusted on the second photoreceptor belt.

19. The system of claim 18, wherein the respective belt velocity of the second photoreceptor belt and the exposure velocities of the image sources on the second photoreceptor belt are simultaneously adjusted, such that the substantially constant difference between the belt velocity and the exposure velocities is maintained during the print run.

20. The system of claim 19, wherein the first print engine and the second print engine are each a multi-color print engine, and the first image and the second image are each a multi-color image.

21. An image processing system comprising:

a seam in a second photoreceptor belt is offset by a period substantially equal to a transit time for a substrate to travel through an inverter between a first print engine and a second print engine, a first period of revolution of a first photoreceptor belt is maintained substantially equal to a second period of revolution of the second photoreceptor belt during a print run;

a substantially constant ratio is maintained between a velocity of the second photoreceptor belt and an exposure velocity of a plurality of imagers during the print run;

a first image is printed on an image receiving substrate at the first print engine; and, a second image is printed on the image receiving substrate at the second print engine.

22. The system of claim 21, wherein the first image has a first image registration error and the second image has a second image registration error that substantially equals the first image registration error.

23. The system of claim 22, wherein the velocity of the second photoreceptor belt and the exposure velocities of the imagers are simultaneously adjusted during the print run.

* * * * *